US006625869B2

(12) United States Patent
Jodo

(10) Patent No.: US 6,625,869 B2
(45) Date of Patent: Sep. 30, 2003

(54) METHOD FOR MANUFACTURING NONRECIPROCAL CIRCUIT DEVICE

(75) Inventor: Takahiro Jodo, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/870,233

(22) Filed: May 30, 2001

(65) Prior Publication Data

US 2002/0002770 A1 Jan. 10, 2002

(30) Foreign Application Priority Data

May 30, 2000 (JP) ..... 2000-160532

(51) Int. Cl.[7] ..... H01F 7/06

(52) U.S. Cl. ..... 29/602.1; 29/607; 29/592.1; 29/832; 29/884; 333/1.1

(58) Field of Search ..... 29/602.1, 607, 29/832, 838, 827, 884, 592.1; 333/1.1, 24.2

(56) References Cited

U.S. PATENT DOCUMENTS 4,749,965 A * 6/1988 Prevot et al. ..... 333/1.1
4,812,787 A * 3/1989 Kuramoto et al.
5,068,629 A * 11/1991 Nishikawa et al. ..... 333/1.1
5,384,556 A * 1/1995 Coles et al. ..... 333/1.1
5,923,224 A * 7/1999 Makino et al. ..... 333/1.1
6,060,958 A * 5/2000 Tokudera et al. ..... 333/1.1
6,107,895 A * 8/2000 Butland et al. ..... 333/1.1
6,121,851 A * 9/2000 Takane et al. ..... 333/1.1
6,366,178 B1 * 4/2002 Makino et al. ..... 333/1.1
2001/0020877 A1 * 9/2001 Hasegawa et al. ..... 333/1.1
2002/0002770 A1 * 1/2002 Jodo ..... 29/602.1

FOREIGN PATENT DOCUMENTS

| | | |
|---|---|---|
| EP | 1067621 A2 | 1/2001 |
| JP | 3-206701 | 9/1991 |
| JP | 9-275305 | * 10/1997 |
| JP | 10-41708 | 2/1998 |
| JP | 10-107510 | 4/1998 |

* cited by examiner

*Primary Examiner*—Carl J. Arbes
*Assistant Examiner*—Minh Trinh
(74) *Attorney, Agent, or Firm*—Keating & Bennett, LLP

(57) ABSTRACT

A method for manufacturing a nonreciprocal circuit device, wherein when the nonreciprocal circuit device, such as an isolator, is manufactured having central conductors disposed adjacent to a magnetic body, to which a DC magnetic field is applied, and a case receiving the central conductors and the magnetic body therein, the central conductors are integral with a hoop and are formed by punching the hoop made of a metal film, the hoop is wound around a reel while the central conductors are transported, and when the nonreciprocal circuit devices are manufactured, the central conductors are fed into a manufacturing step after being separated from the hoop.

4 Claims, 3 Drawing Sheets

METHOD FOR MANUFACTURING NONRECIPROCAL CIRCUIT DEVICE

BACKGROUND OF THE INVENTION

1. Field of the Invention

The present invention relates to methods for manufacturing nonreciprocal circuit devices, such as isolators, used in a high frequency region such as microwaves.

2. Description of the Related Art

The number of subscribers to mobile phones is continuously increasing, and in addition to the increase in new subscribers, replacement demand for new models is also increasing. Accordingly, devices necessary for the mobile phones are also increasingly required to have shorter delivery time and reduce cost. Nonreciprocal circuit devices used as isolators and the like, necessary devices in mobile phones, also need to satisfy the requirements described above.

Conventionally, a lumped-constant type circulator is composed of a plurality of central conductors which are located adjacent to a ferrite plate and are disposed so as to cross each other, a magnet applying a DC magnetic field to the ferrite plate, and a case receiving the elements described above therein. In addition, an isolator is formed by a resistor termination at a predetermined port among three ports of the circulator.

The central conductor constituting the nonreciprocal circuit device described above is conventionally formed by etching or punching a metal foil. However, when the central conductors are manufactured by an etching method, the manufacturing time is long because of a complicated etching process, and the lead time from order entry to delivery is long, whereby smooth delivery cannot be performed when production volume is suddenly increased. In addition, there are problems in that the manufacturing cost is high, and cost reduction is difficult to preform. Furthermore, in the etching process, variation in line widths of circuits, such as, a trapeziform cross-section of line width, is likely to occur because of a so-called over-etching, under-etching, or the like, and as a result, variation in performances of the nonreciprocal circuit devices may occur in some cases.

On the other hand, when the central conductors are manufactured by a punching method, compared to the etching method, advantages can be obtained in that the manufacturing time is shorter, the cost can be reduced, variation in line widths is smaller, and hence, variation in performances of the nonreciprocal circuit device can be reduced. However, a problem may arise in that when the central conductors itself are delivered, breakage or bending is likely to occur during transportation. In addition, when the central conductors are fed to a manufacturing step using an automatic machine, a plurality of central conductors must be aligned beforehand, and the time required for alignment is long, whereby the advantage, which can be obtained by using the automatic machine, is reduced by half.

SUMMARY OF THE INVENTION

Accordingly, an object of the present invention is to provide a method for manufacturing a nonreciprocal circuit device which can solve the problems occurred in an etching method and in a punching method, can significantly improve the productivity, and can manufacture a nonreciprocal circuit device having excellent performances.

According to this present invention, in a method for manufacturing a nonreciprocal circuit device comprising a magnetic body to which a DC magnetic field is applied, central conductors disposed adjacent to the magnetic body, and a case containing the magnetic body and the central conductors, the method comprises the steps of punching a metal foil in a hoop form by a die so as to form the central conductors for a plurality of the nonreciprocal circuit devices which are integrated, separating the central conductors from the metal foil in the hoop form, disposing the central conductors adjacent to the magnetic body, and placing the central conductors and the magnetic body in the case.

As described above, when the central conductors for the plurality of the nonreciprocal circuit devices are formed in an integrated state by punching the metal foil in the hoop form, the occurrence of the breakage and bending of the central conductors during transportation is prevented, and when the central conductors are fed into a manufacturing step by an automatic machine, the central conductors aligned beforehand can be fed thereinto.

In addition, according to the present invention, the metal foil may comprise at least one of the elements selected from a group consisting of iron, copper, and aluminum, and a metal film having a resistivity of 5.5 $\mu\Omega\cdot$cm or less may be provided on the metal foil. In this structure, the breakage and bending of the central conductors are unlikely to occur even when a thin metal foil is used, and in addition, the conductor loss can also be reduced.

In the present invention, the metal foil may be a flat-rolled copper foil. In this case, the conductor loss can be further reduced by making the obverse and reverse surfaces of the metal foil smooth, and even when the thickness thereof is deceased, a strength at a certain level can be maintained.

Furthermore, according to the present invention, the method for manufacturing the nonreciprocal circuit device may further comprises the steps of forming the central conductors extending in radial directions from a stage on which the magnetic body is placed, bending the central conductors so as to wrap around the magnetic body, and insulating between the central conductors overlapped with each other by bending with insulating sheets, wherein a base material of the insulating sheet comprises at least one of the elements selected from a group consisting of a polyimide, a polyester, an aramid, a polyamide-imide, and a fluorinated resin, and the base material has a thickness of 0.05 mm or less. Consequently, the overall thickness of the nonreciprocal circuit device including the insulating sheets can be decreased, and the electrical insulating state between the central conductors overlapped with each other can be reliably maintained.

DESCRIPTION OF THE PREFERRED EMBODIMENTS

Referring to FIGS. 1 to 4B, the structure of an isolator of the embodiment according to the present invention and a manufacturing method therefor will be described.

Figure 1:
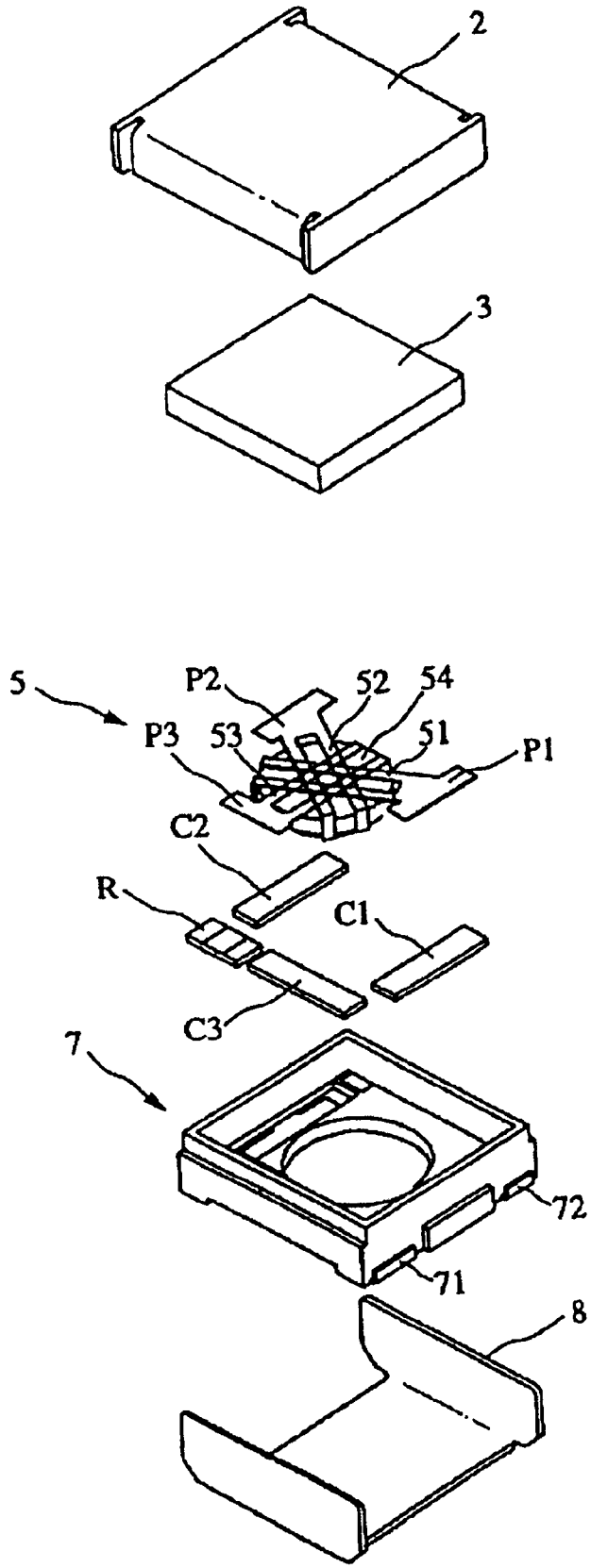
FIG. 1 is an exploded perspective view showing an isolator according to an embodiment.

FIG. 1 is an exploded perspective view of the isolator. In FIG. 1, an upper yoke 2 has a box shape made of a magnetic metal, and a rectangular permanent magnet 3 is disposed inside the upper yoke 2. A magnetic assembly 5 is composed of a disk-shape ferrite 54 and central conductors 51, 52, and 53. The central conductors 51, 52, and 53 are connected with a disk-shape stage for magnetic body, and the ferrite 54 is placed on the stage for magnetic body. The central conductors 51, 52, and 53 are bent so as to wrap around the ferrite 54. In this figure, even though detailed exterior appearance is omitted in order to make the drawing simple, when the central conductors 51, 52, and 53 are sequentially bent so as to wrap around the ferrite 54, insulating sheets having the same disk shape as that of the ferrite 54 are stacked in order to electrically insulate between the central conductors. The ends of the central conductors 51,52, and 53 define ports P1, P2, and P3, respectively. In a resin case 7, a ground electrode having a part thereof exposed on an upper surface inside of the case, terminals 71, 72 exposed from the bottom surface to the side surface of the case, and the like are provided by insert-molding. Matching capacitors C1, C2, and C3 are connected to the ground electrode in the resin case 7 and are connected to the ports P1, P2, and P3, respectively. In addition, a termination resistor R is connected to an electrode which is electrically connected to the port 3, and to the ground electrode. A lower yoke 8 is made of a magnetic metal, and a closed magnetic circuit is constituted in combination of the upper yoke 2 and the lower yoke 8. According to this configuration, a magnetic field by the permanent magnet 3 is applied to the ferrite 54 in the thickness direction thereof.

Figure 2A:
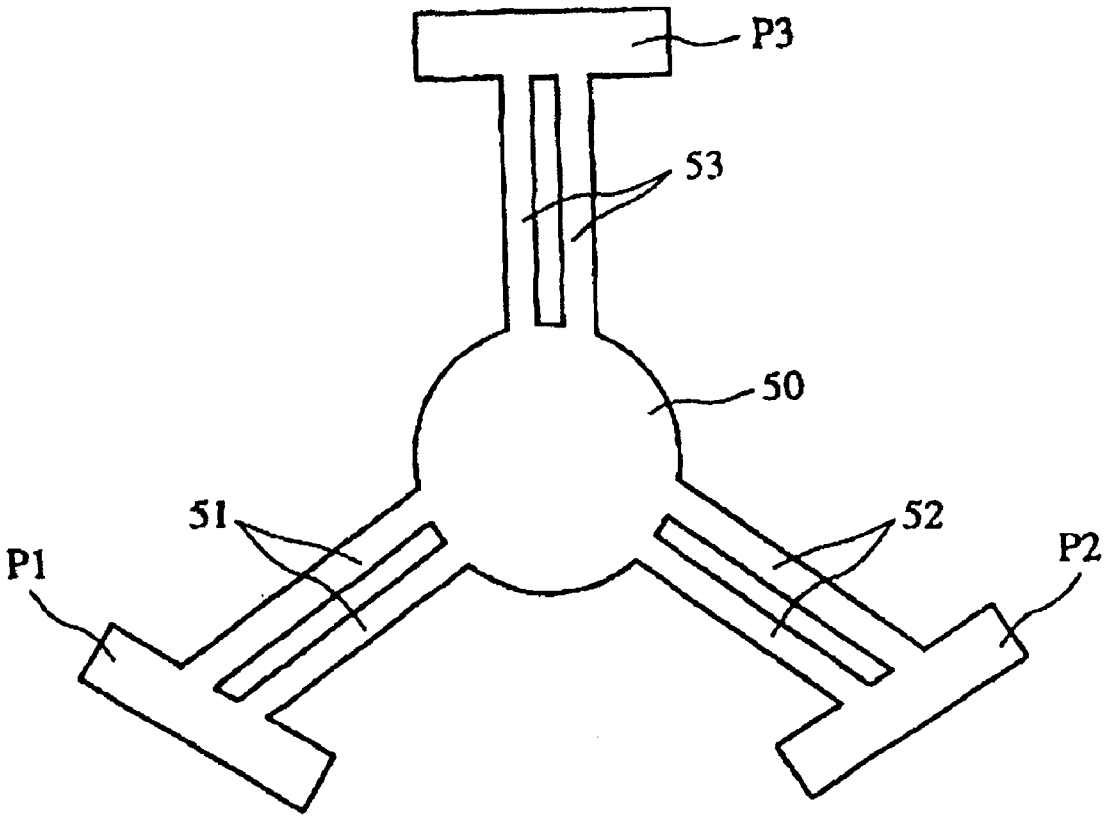
FIG. 2A is a plan view of central conductors for use in the isolator.
Figure 2B:
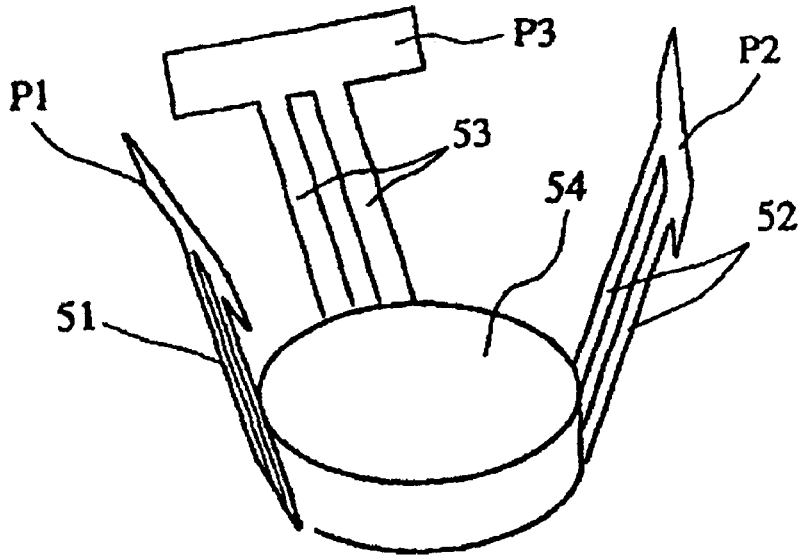
FIG. 2B is a perspective view showing a state in which the central conductors are being bent.

FIG. 2A is a plan view showing the central conductors before bending is performed, and FIG. 2B is a perspective view showing the state in which the central conductors are being bent. A portion indicated by reference numeral 50 in FIG. 2A is the stage for magnetic body, and the ferrite 54 is placed thereon. The central conductors 51, 52, and 53 extend in three directions from the stage 50 for magnetic body, and the front ends of the conductors define the ports P1, P2, and P3, respectively. The stage 50 for magnetic body and the central conductors 51, 52, and 53 connected therewith are punched by a pressing work performed on a metal foil as described below.

The ferrite 54 is placed on the stage 50 for magnetic body in the state shown in FIG. 2A, the central conductor 51 is then bent, a first insulating sheet provided with an adhesive film thereunder is adhered to the central conductor 51. Subsequently the central conductor 52 is bent to be overlapped with the first insulating sheet, a second insulating sheet provided with an adhesive film thereunder is adhered to the central conductor 52. The central conductor 53 is subsequently bent to be overlapped with the insulating sheet, and a third insulating sheet provided with an adhesive film thereunder is adhered to the central conductor 53. As a result, the magnetic assembly 5 shown in FIG. 1 is formed.

As a base material for the insulating sheet described above, a polyimide, a polyester, an aramid, a polyamide-imide, or a fluorinated resin (polytetrafluoroethylene, PTFE) is used. Since the central conductors are formed by a pressing work, so-called burrs are generated. However, when the synthetic resins described above are used, the burrs hardly penetrate through the synthetic resins, even when the thickness of the resin is reduced. Therefore, the entire magnetic assembly 5 can be formed thinner by using the base material having a thickness of approximately 0.05 mm or less for the insulating sheet.

For example, important points for the customers to select recent mobile phones are compact and light-weight, and hence, an isolator used in the mobile phone is also required to be thin, such as 2 mm or less. As described above, since three insulating sheets per isolator are used for forming insulation between the central conductors and are stacked with each other with the central conductors interposed therebetween, three times the thickness of the insulating sheet has an impact to the height of the isolator even if the thickness of one insulating sheet is not significant. For example, when an insulating sheet 0.1 mm thick and an insulating sheet 0.05 mm thick are used, the difference in height between the isolators is $(0.1-0.05)\times3=0.15$ mm, and a height of 0.15 mm is approximately 7.5% of a height of 2 mm, whereby it is significantly effective to use a thinner base material of the insulating sheet in order to decrease the height of the entire isolator.

Figure 3:
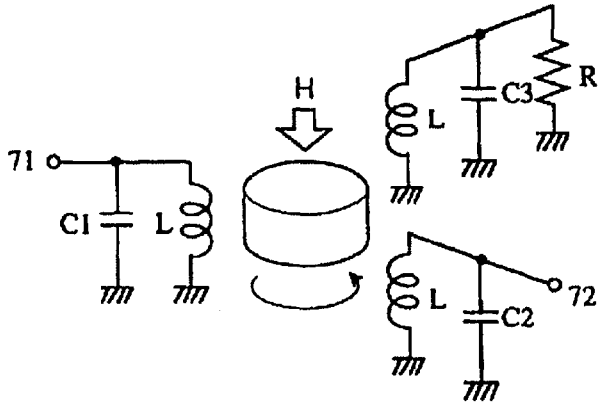
FIG. 3 is a view showing an equivalent circuit diagram of the isolator.

FIG. 3 is a diagram showing an equivalent circuit of the isolator. In FIG. 3, L is an equivalent inductor constituted by the ferrite 54 and the central conductors 51, 52, and 53. The capacitors C1, C2, and C3 are provided so that the capacitances thereof are matched with the inductance of the inductor L for obtaining low insertion loss characteristics in a predetermined bandwidth centered at a predetermined frequency. Reference numeral 71 indicates an input terminal, reference numeral 72 indicates an output terminal, and signals supplied to the input terminal 71 are output from the output terminal 72. Most of signals supplied to the output terminal 72 are not output from the input terminal 71 side and are terminated by the resistor R.

Figure 4A:
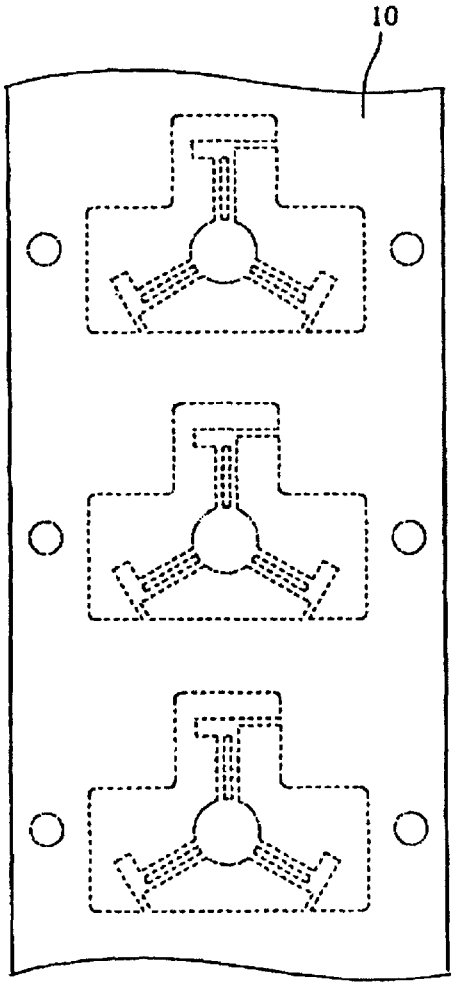
FIG. 4A is a view illustrating a step for manufacturing central conductors for use in the isolator before punching is performed.
Figure 4B:
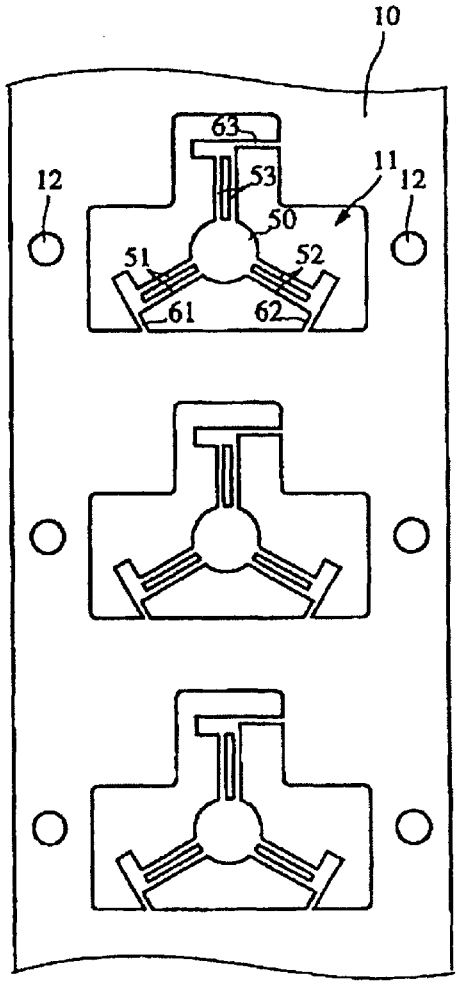
FIG. 4B is a view illustrating a step for manufacturing central conductors for use in the isolator after punching is performed.

FIGS. 4A and 4B are views each illustrating a method for manufacturing the central conductors described above. FIG. 4A shows a hoop before punching is performed, in which a pattern to be punched is shown by a dashed line. FIG. 4B shows a hoop 10 after the pattern shown by the dashed line is punched. In this figure, reference numeral 11 indicates an area punched to form the central conductor. The ports are integrally formed at the ends of the central conductors 51, 52, and 53, respectively. Portions of the ports define connection portions 61, 62, and 63, and the ports remain integrally connected with the hoop 10 via the connection portions. Since the inside ends of the central conductors 51, 52, and 53 are integrally connected with the stage 50 for magnetic body, each central conductor is supported at the both ends thereof, and hence, the central conductors are supported by the hoop with a sufficient strength.

In addition, as shown in FIG. 4B, since the central conductors are integrally connected with the hoop at three locations, and at least two locations thereof are approximately symmetrical with respect to the centerline of the hoop in the direction which the hoop is fed, the position of the central conductor is stable with respect to the hoop. Accordingly, when the hoop is wound around a reel, when the central conductors integrally connected with the hoop are transported, and when the hoop is unwound from the reel, breakage and bending of the central conductors can be reliably prevented. In addition, when the widths of the connection portions 61, 62, and 63 are set to be 0.1 mm or less, punching cannot be performed by a die, and when the widths are set to be 1 mm or greater, it becomes difficult to provide the connection portions at end portions (ports) of the central conductors. Accordingly, the widths of the connection portions 61, 62, and 63 are determined in the range of from 0.1 mm to less than 1.0 mm.

In addition, in FIGS. 4A and 4B, the entire width of the hoop is approximately 1.9 times the width of the central conductor area. When the entire width of the hoop is not more than 4 times the width of the central conductor area, the amount of waste material is not excessive. When the entire width is not less than 1.2 times the width of the central conductor area, the hoop is not broken when it is automatically fed, even though the width of a material forming the hoop becomes smaller after the central conductors are formed by punching with a die. As a result, the entire width of the hoop is determined in the range of 1.2 to 4 times the width of the central conductor area.

The diameter of a sprocket hole 12 is set in the range of 0.2 to 5 mm, or a rectangular sprocket hole is formed having one side length in the range of 0.2 to 5 mm. As a result, the amount of waste material is not increased, and hence, cost reduction can be achieved.

The hoop 10 is made of a metal foil containing at least one of iron, copper, and aluminum having a thickness in the range of 0.01 to 0.10 mm. When iron is used as a mother material, the entire cost reduction can be achieved due to the low material cost. In addition, on the surface of the mother material, when a metal film of gold, silver, copper, or aluminum or the like, which has a resistivity of 5.5 $\mu\Omega\cdot$cm or less is formed, the resistivity is decreased in the skin in which a high-frequency current flows, and thinner devices can be accomplished. Furthermore, when iron is used as the mother material, since the rigidity of the hoop and the central conductor is increased, the breakage and bending can be more reliably prevented which occur during transportation. In addition, when copper or aluminum having a resistivity of 5.5 $\mu\Omega\cdot$cm or less is used, the metal film for decreasing the skin resistance is not required. Furthermore, when aluminum is used as the mother material, lightweight devices can be accomplished.

The metal film on the mother material may be formed by plating a metal foil in the form of a roll before the hoop is formed. Alternatively, the metal film may be formed by plating the surface of a hoop after the hoop is formed by cutting a metal foil as shown in FIG. 4A. Further the metal film may be formed by performing plating at a stage when central conductors are formed in the hoop as shown in FIG. 4B.

As described above, when plating is performed while the central conductors are integrally connected with the hoop 10, a plating film can be formed on edge portions (cut surfaces formed by punching) of the central conductor, and the effect of reducing the conductor loss by a skin effect can be improved.

When a flat-rolled copper foil is used as a mother material for the hoop 10, the surface roughness of both sides of the mother material is small, and hence, the loss can be reduced in the area in which a high-frequency current flows. For example, when an electrolytic copper foil is used, since only a side surface thereof is smooth, and the surface roughness of the other side has a larger than the above-mentioned side, a problem of conductor loss by the skin effect may occur when the copper foil is used without being processed.

In the hoop 10, the sprocket holes 12 are formed at intervals equivalent to those for feeding the central conductors. When the hoop 10 is fed by an automatic machine, since the hoop 10 is fed by engaging the sprocket holes 12 with sprockets, the feeding interval of the central conductors can be uniform, and accuracy of alignment of the central conductor can be improved. For example, when an automatic production line is constructed to form the central conductors by punching with a die while the hoop 10 is being fed by the automatic machine for feeding the hoop 10, punching can be performed by the die at a constant feeding speed of the hoop 10, and the accuracy of cutting position can be improved.

According to the present invention, since central conductors for a plurality of the nonreciprocal circuit device are formed in an integrated state by punching a metal foil in a hoop form, the breakage and bending of the central conductors can be prevented which occur during transportation, and when the central conductors are fed into a manufacturing step by an automatic machine, the central conductors aligned beforehand can be fed thereinto.

In addition, according to the present invention, when the metal foil comprises at least one of iron, copper, and aluminum, and when a metal film having a resistivity of 5.5 $\mu\Omega\cdot$cm or less is formed on the surface of the metal foil, the breakage and bending of the central conductors are unlikely to occur even when a thin metal foil is used, and the conductor loss can be reduced.

According to the present invention, when a flat-rolled copper foil is used for the metal foil, the conductor loss can be reduced by virtue of smoother surfaces of the obverse and reverse sides of the metal foil, and even when the thickness thereof is decreased, since a strength at a certain level is maintained, the breakage and bending do not occur, and hence, the productivity of the nonreciprocal circuit device can be increased.

Furthermore, according to the present invention, since the central conductors are bent so as to wrap around the magnetic body, and insulating sheets, which are primarily composed of one of a polyimide, a polyester, an aramid, a polyamide-imide, and a fluorinated resin, and which have a thickness of 0.05 mm or less, is provided between the central conductors, the electrical insulating state between the central conductors can be reliably maintained, and a thin nonreciprocal circuit device can be produced.

What is claimed is:

1. A method for manufacturing a nonreciprocal circuit device comprising the steps of:

punching a metal foil in a hoop form by a die so as to integrally form a plurality of central conductors for a plurality of nonreciprocal circuit devices on the metal foil;

separating the plurality of central conductors from the metal foil in the hoop form;

disposing a respective one of the plurality of central conductors adjacent to a magnetic body; and placing the respective one of the plurality of central conductors and the magnetic body in a case.

2. The method for manufacturing the nonreciprocal circuit device, according to claim 1, wherein the metal foil is formed of at least one of iron, copper, and aluminum, and a metal film having a resistivity of about 5.5$\mu\Omega\cdot$cm or less is provided on the metal foil.

3. The method for manufacturing the nonreciprocal circuit device, according to claim 1 or 2, wherein the metal foil is a flat-rolled copper foil.

4. The method for manufacturing the nonreciprocal circuit device, according to claim 1, further comprising the steps of:

forming the respective one of the plurality of central conductors extending in radial directions from a stage on which the magnetic body is placed;

bending the respective one of the plurality of central conductors so as to wrap around the magnetic body; and insulating between the respective one of the plurality of central conductors overlapped by bending with at least one insulating sheet;

wherein a base material of the at least one insulating sheet is formed of at least one of a polyimide a polyester, an aramid, a polyamide-imide, and a fluorinated resin, and the base material has a thickness of about 0.05 mm or less.

* * * * *